US006216274B1

(12) United States Patent
Harris

(10) Patent No.: US 6,216,274 B1
(45) Date of Patent: Apr. 17, 2001

(54) NURSING COVER UP WITH A PEEK-A-BOO POCKET

(76) Inventor: Jodi Harris, 121 Kalley Dr., Goleta, CA (US) 93119

( * ) Notice: Subject to any disclaimer, the term of this patent is extended or adjusted under 35 U.S.C. 154(b) by 0 days.

(21) Appl. No.: 09/627,561

(22) Filed: Jul. 28, 2000

(51) Int. Cl.[7] ..... A41D 1/20; A41D 1/22
(52) U.S. Cl. ..... 2/104; 2/48
(58) Field of Search ..... 2/104, 48, 88, 2/46, 49.1, 49.2, 50, 51, 102, 105, 106, 114, 247; 450/36

(56) References Cited

U.S. PATENT DOCUMENTS

| | | | | |
|---|---|---|---|---|
| 778,014 | * | 12/1904 | Coyle | 2/104 |
| 4,004,294 | * | 1/1977 | Pinch | 2/104 |
| 4,663,782 | * | 5/1987 | Knox et al. | 2/104 |
| 4,995,116 | * | 2/1991 | Beauchamp et al. | 2/104 |
| 5,034,999 | * | 7/1991 | Lubbers | 2/104 |
| 5,259,068 | * | 11/1993 | Carroll | 2/104 |
| 5,652,958 | * | 8/1997 | Farrell-Mestas | 2/48 |
| 5,848,439 | * | 12/1998 | Huseth et al. | 2/104 |
| 5,893,171 | * | 4/1999 | Ries | 2/48 |

FOREIGN PATENT DOCUMENTS

| | | | | |
|---|---|---|---|---|
| 2246947 | * | 2/1992 | (GB) | 2/104 |

* cited by examiner

*Primary Examiner*—Amy B. Vanatta
(74) *Attorney, Agent, or Firm*—Raymond Y. Chan; David and Raymond Patent Group

(57) ABSTRACT

A nursing cover up includes a body cover having a size adapted for covering at least a chest portion of a mother user and a hanging means for hanging the body cover in front of the mother user. The body cover further includes a peek-a-boo pocket which has a viewing opening formed on a pocket panel that separates the pocket panel into an upper piece and a lower piece. The peek-a-boo pocket includes a shield flap which extends from a bottom portion of the upper piece of the pocket panel to overlappingly position behind an upper portion of the lower piece of the pocket panel for covering an upper portion of a breast of the mother user, and a pocket lip formed at a top edge of the upper portion of the lower piece, so as to define the viewing opening between the shield flap and the pocket lip for the mother user to monitor her baby therethrough while breastfeeding. Accordingly, during breastfeeding, the nursing cover up can effectively cover up the mother's breast from being seen by anyone in all direction while maintaining good air ventilation for the baby and enabling the mother herself to monitor the breastfeeding of her baby through the peek-a-boo pocket, so that the mother may feel comfortable to breastfeed her baby anytime in anywhere.

20 Claims, 4 Drawing Sheets

NURSING COVER UP WITH A PEEK-A-BOO POCKET

BACKGROUND OF THE PRESENT INVENTION

1. Field of Invention

The present invention relates to a cover up, and more particularly to a nursing cover up with a peek-a-boo pocket for mothers to comfortably nurse their baby everywhere with privacy while maintaining their femininity and beauty.

2. Description of Related Arts

Giving birth to a baby is for parents, especially for mothers who had physically and mentally prepared to breastfeed their babies. Breastfeeding has many advantages for babies and their mothers. The breast milk contains higher amounts of nutrients that babies need. Also, epidemiological research shows that breast milk provides extra protection from inflection and other problems that are especially common among babies. For many mothers, breastfeeding is one of the connections that they have with their babies during this period. Mothers report that both they and their babies enjoy the special closeness that occurs during breastfeeding.

However, many mothers claim that breastfeeding their babies in public is embarrassing since they may need to take off their clothes and expose their bodies that may destroy their beauty and femininity. So, most mothers will first save their breast milk in a bottle and feed their babies with the loaded bottle whenever their babies feel hungry. However, the bottles of breast milk may increase the workload to the mothers such as prepare the breast milk in the bottle. Also, it is really difficult to keep the freshness of the bottles of breast milk during outdoors. Therefore, one of the solutions for breastfeeding in public is that mothers have to hide at a corner or a nursing room that seldom stores provide. Furthermore, breastfeeding in public is considered to be illegal in some countries and mothers may be charged as the improper conduct since they expose their bodies in public. Breastfeeding their babies is such a natural thing should not be prohibited and should have the right to nurse their babies anytime or anywhere.

Another alternative solution for breastfeeding in public is to use a blanket to cover up the baby and the exposed breast while breastfeeding, such as U.S. Pat. Nos. 5,479,662 and 5,008,960. However, just a blanket with a strap for anti-fall off still fails to effectively hiding the mother's breast from being seen in all direction. In fact, for most of the conventional blanket type cover up, the mother's breast is still be seen by someone next to the mother.

SUMMARY OF THE PRESENT INVENTION

A main object of the present invention is to provide a nursing cover up with a peek-a-boo pocket, which, during breastfeeding, can effectively cover up the mother's breast from being seen by anyone in all direction while maintaining good air ventilation for the baby and enabling the mother herself to monitor the breastfeeding of her baby through the peek-a-boo pocket, so that the mother may feel comfortable to breastfeed her baby anytime in anywhere.

Another object of the present invention is to provide a nursing cover up with a peek-a-boo pocket, which properly covers a front side of the nursing mother for keeping privacy.

Another object of the present invention is to provide a nursing cover up with a peek-a-boo pocket, which can be used by a mother to either cover her right breast or left breast selectively by the same nursing cover up.

Another object of the present invention is to provide a nursing cover up with a peek-a-boo pocket adapted for maintaining the femininity and beauty when mothers nurse their baby.

Accordingly, in order to accomplish the above objects, the present invention provides a nursing cover up with a peek-a-boo pocket, which comprises:

a body cover having a size adapted for covering at least a chest portion of a mother user and a hanging means for hanging the body cover in front of the mother user, wherein the body cover comprises a main panel, a side panel and a pocket panel positioned between the main panel and the side panel, wherein the pocket panel and the side panel are capable of covering one side of the chest portion of the mother user while the main panel is capable of covering another side of the chest portion of the mother user, wherein the body cover further comprises a peek-a-boo pocket which has a viewing opening formed on the pocket panel that separates the pocket panel into an upper piece and a lower piece, the peek-a-boo pocket comprising a shield flap which extends from a bottom portion of the upper piece of the pocket panel to overlappingly position behind an upper portion of the lower piece of the pocket panel for covering an upper portion of a breast of the mother user, and a pocket lip formed at a top edge of the upper portion of the lower piece wherein the upper portion of the lower piece of the pocket panel is wider than the bottom portion of the upper piece so as to define the viewing opening between the shield flap and the pocket lip for the mother user to monitor her baby therethrough while breastfeeding.

In a preferred embodiment of the present invention, in order to better support the peek-a-boo pocket, the peek-a-boo pocket further comprises means for supporting the pocket lip to keep apart from the shield flap so as to maintain the viewing opening in an open condition for ease of monitoring.

The supporting means may comprises a supporting lining layer attached to at least the upper portion of the lower piece so as to increase the weight of lower piece of the pocket panel with respect to the upper piece of the pocket panel, the main panel and the side panel, so that the heavier upper portion of the lower piece of the pocket panel will remain dropping apart from the shield flap due to gravity. Alternatively, the supporting means can be a flexible supporting wire extended along the pocket lip.

DETAILED DESCRIPTION OF THE PREFERRED EMBODIMENT

Figure 1:
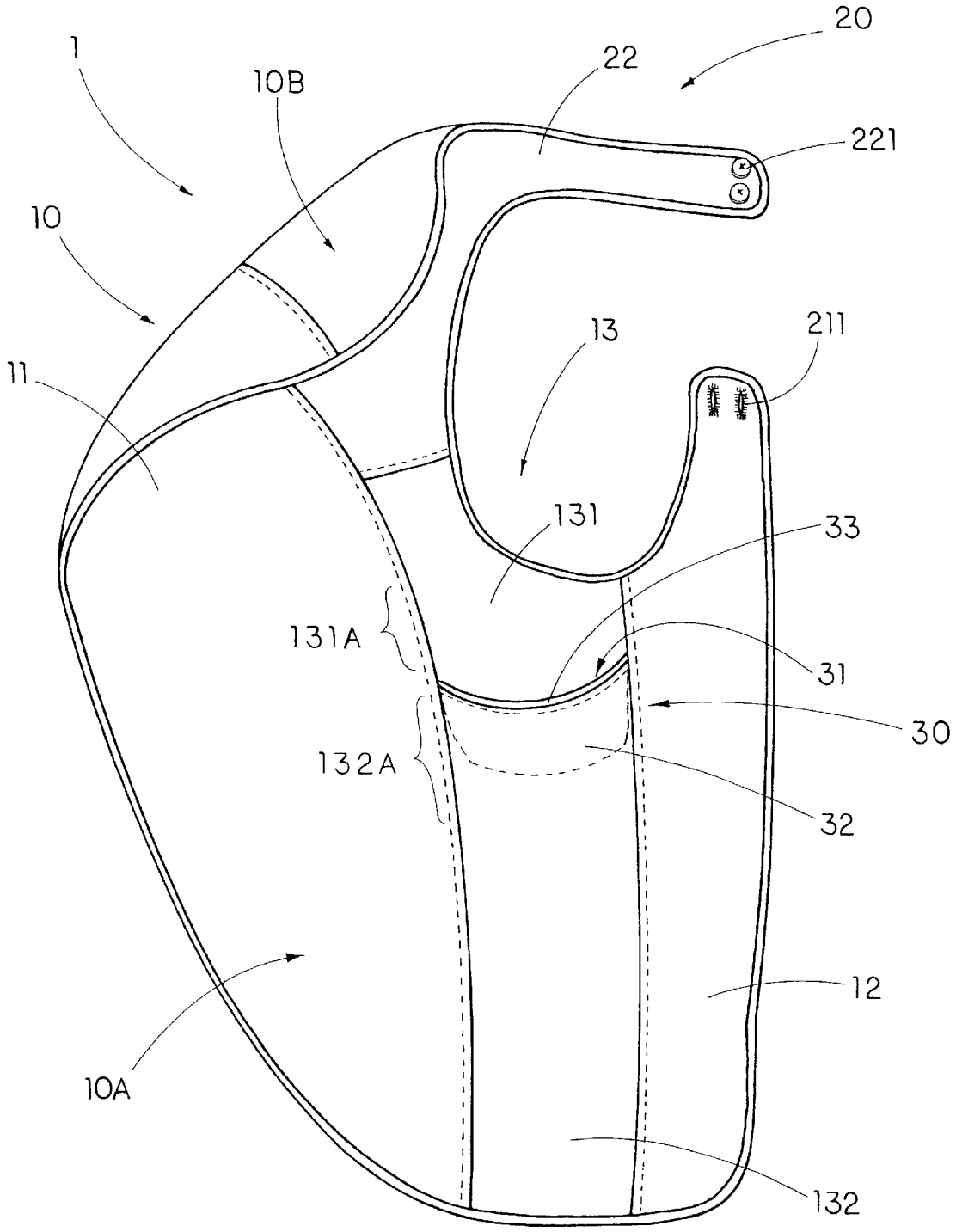
FIG. 1 is a perspective view of a nursing cover up with a peek-a-boo pocket according to a preferred embodiment of the present invention.
Figure 2:
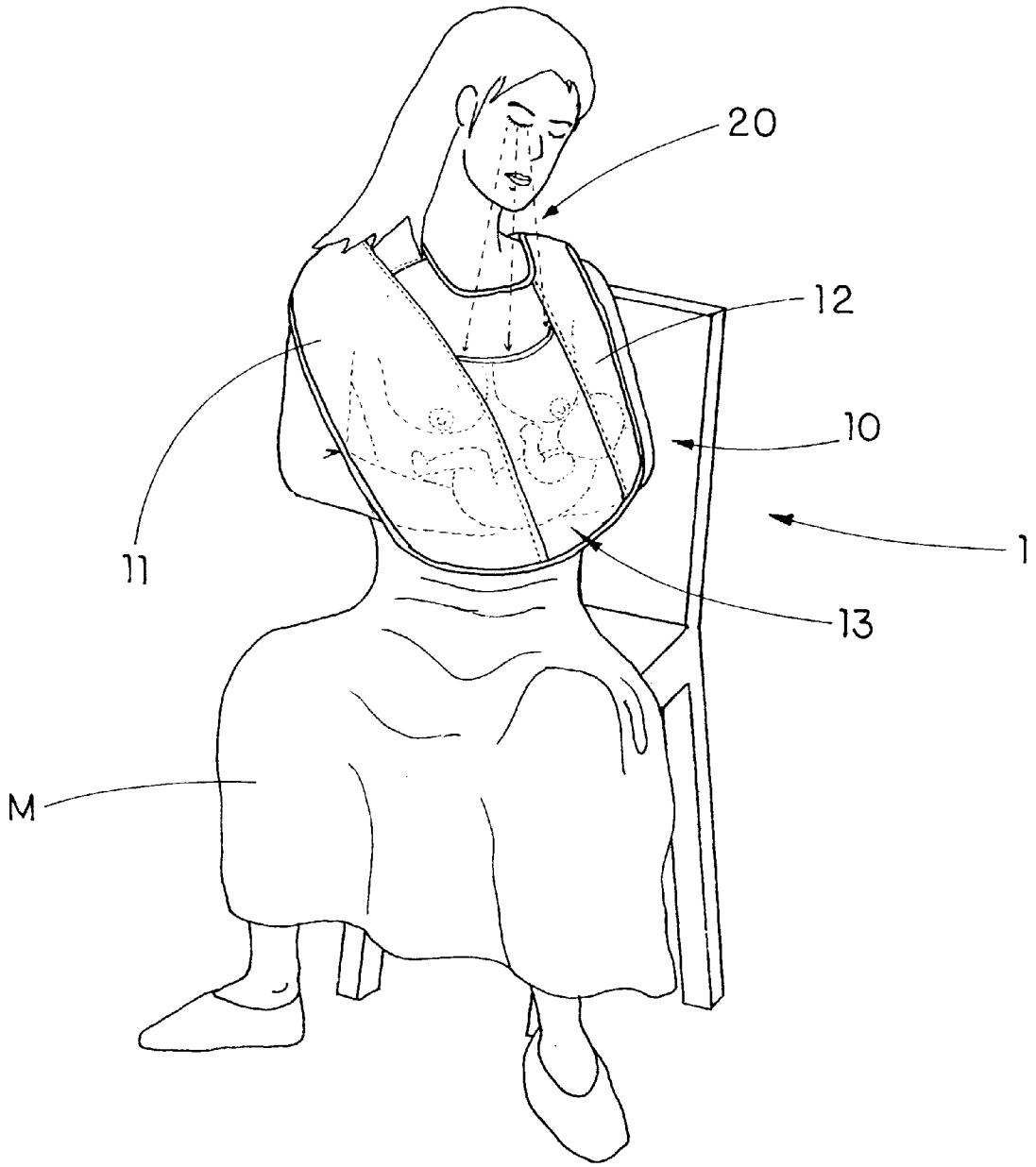
FIG. 2 is a perspective view illustrating a mother who is using the nursing cover up of the invention to nurse her baby according to the above preferred embodiment of the present invention.
Figure 3:
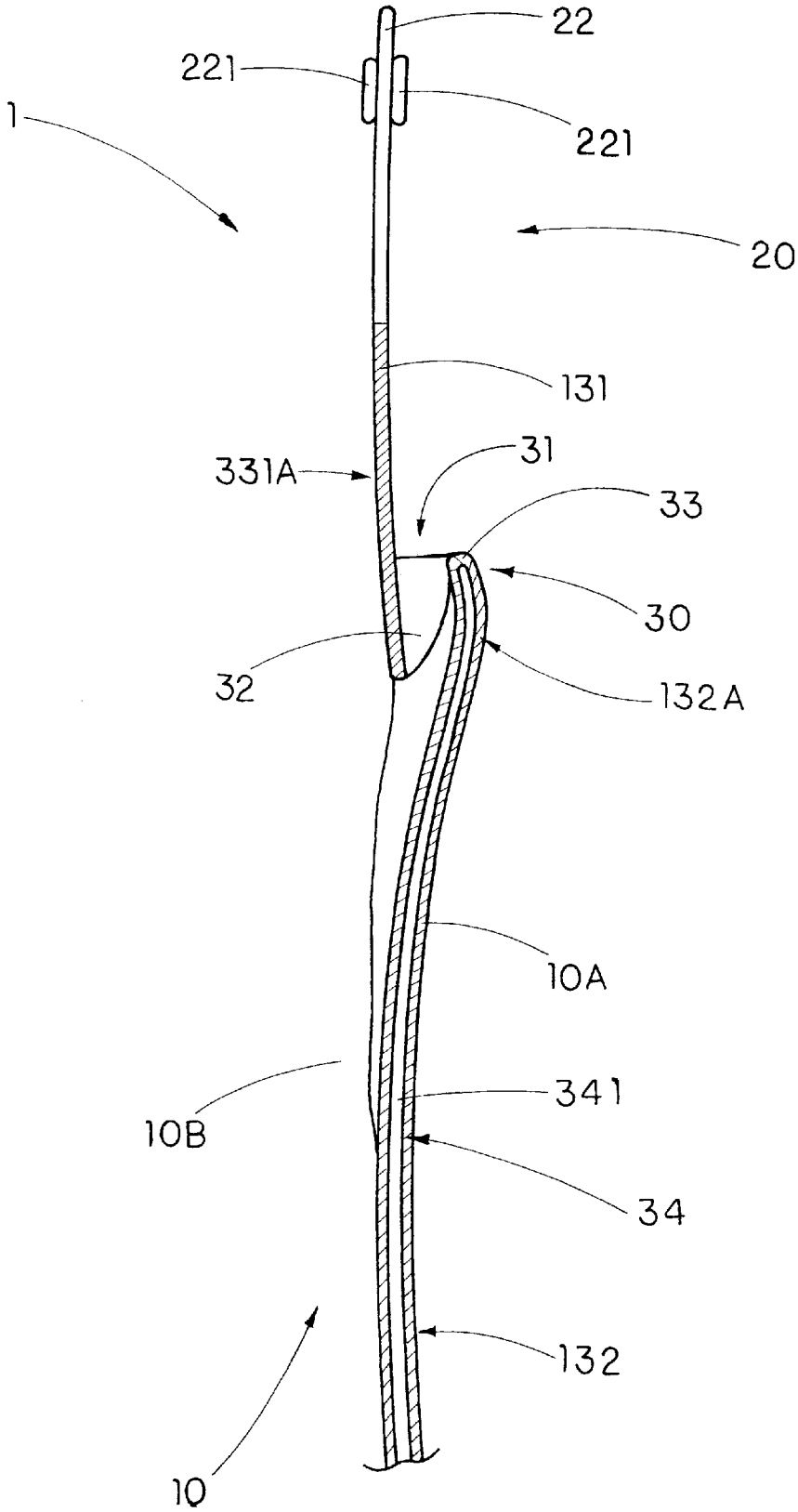
FIG. 3 is a sectional side view of the nursing cover up according to the above preferred embodiment of the present invention.

Referring to FIGS. 1 to 3 of the drawing, a nursing cover up 1 according to a preferred embodiment of the present invention is illustrated, which comprises a body cover 10 having a size adapted for covering at least a chest portion of a mother user M and a hanging means 20 for hanging the body cover 10 in front of the mother user M.

The body cover 10 comprises a main panel 11, a side panel 12 and a pocket panel 13 positioned between the main panel 11 and the side panel 12. As shown in FIG. 2, the pocket panel 13 and the side panel 12 are capable of covering one side of the chest portion of the mother user M while the main panel 11 is capable of covering another side of the chest portion of the mother user M. The side panel 12, which is an edge piece adapted to cover one side edge of the chest portion of the mother user M, works with the main panel 11 to support the pocket panel 13 to hang down in front of the mother user M. The main panel 11 is preferred to be made large enough to cover one shoulder of the mother user M, as shown in FIG. 2.

The body cover 10 further comprises a peek-a-boo pocket 30, which has a viewing opening, 31 formed on the pocket panel 13 that separates the pocket panel 13 into an upper piece 131 and a lower piece 132.

The peek-a-boo pocket 30 comprises a shield flap 32 which extends from a bottom portion 131A of the upper piece 131 of the pocket panel 13 to overlappingly position behind an upper portion 132A of the lower piece 132 of the pocket panel 13 for covering an upper portion of a breast of the mother user M, and a pocket lip 33 formed at a top edge of the upper portion 132A of the lower piece 132, wherein the upper portion 132A of the lower piece 132 of the pocket panel 13 is wider than the bottom portion 131A of the upper piece 131 so as to define the viewing opening 31 between the shield flap 32 and the pocket lip 33 for the mother user M to monitor her baby therethrough while breastfeeding.

The body cover 10, having, a first side 10A and a second side 10B, is designed to be worn as a demi-cover up or cover uplet, which is preferably made of cotton or poly-cotton for comfort, breathability and easy care for wash and wear. The body cover 10 is cut to be slightly off its center in order to provide a maximum coverage on the chest portion of the mother user M, wherein the body cover 10 has a predetermined length approximately equal to a length from a shoulder to a waist of the nursing mother user M.

In a preferred embodiment of the present invention, as shown in FIG. 3, in order to better support the peck-a-boo pocket 30, the peek-a-boo pocket 30 further comprises means 34 for supporting the pocket lip 33 to keep apart from the shield flap 32 so as to maintain the viewing, opening, 31 in an open condition for ease of monitoring.

The supporting means 34 comprises a supporting lining layer 341 attached to at least the upper portion 132A of the lower piece 132 so as to increase the weight of lower piece 132 of the pocket panel 13 with respect to the upper piece 131 of the pocket panel 13, the main panel 11 and the side panel 12, so that the heavier upper portion 132A of the lower piece 132 of the pocket panel 13 will remain dropping, apart from the shield flap 32 due to gravity, as shown in FIG. 3.

According, to the above preferred embodiment as shown in FIGS. 1 to 3, the supporting lining layer 341 which is made of a stiffness lining fabric is stitched to attach on the entire lower piece 132 of the pocket panel 13 such that the lower piece 132 of the pocket panel 13 is thicker than the upper piece 131 of the pocket panel 13, the main panel 11 and the side panel 12 of the body cover 10. The pocket panel 13 is arranged to align with one of the mother user's breasts.

The viewing opening 31 of the peek-a-boo pocket 30 enables the mother user M to view and monitor her baby through the viewing opening 31 of the peek-a-boo pocket 30 during breastfeeding, as shown in FIG. 2. Therefore, the weight of the lower piece 132 will pull the pocket lip 33 to fall down to form an arc shaped in order to define the viewing opening 31 between the shield flap 32 and the pocket lip 33 for the mother user M to monitor her baby therethrough while breastfeeding.

In other words, since the stiffness supporting lining layer 34 stitched to the lower piece 132 of the pocket panel 13 having a relative weight is heavier than the rest part of the body cover 10, the wider upper portion 132A of the lower piece 132 of the pocket panel 11 is automatically and naturally dropped down due to gravity to ensure the viewing opening 31 of the peek-a-boo pocket 30 to remain opened.

The joining edges of the shield flap 32 and the pocket lip 33 are reinforced by seams so as to prevent the peek-a-boo pocket 30 from being torn off. Furthermore, the viewing opening 31 of the peek-a-boo pocket 30 will remain open when the mother is feeding her baby such that the baby is supplied with fresh air via the viewing opening 31 of the peek-a-boo pocket 30 for better ventilation. Preferably, the peek-a-boo pocket 30 is stitched approximately 3 to 8 inches down from the shoulder of the mother user M and the viewing opening 31 of the peek-a-boo pocket 30 is about 6–7 inches width.

The shield flap 32 of the peek-a-boo pocket 30 is integrally and downwardly extended from the bottom portion 131A of the upper piece 131 of the pocket panel 13.

The shield flap 32 not only forms a part of border around the viewing opening 31, but also is adapted for partially covering an upper portion of the mother's breast so as to shade a top exposure of the peek-a-boo pocket 30 such that only the nursing mother is able to view and monitor her baby during breastfeeding. Two sides of the shield flap 32 are remained to connect with neither the upper piece 131 nor the lower piece 132. Hence, the shield flap 32 is adapted to be reversibly flipped over from the first side 10A to the second side 10B of the body cover 10, for example, such that the shield flap 32 is capable of shading the viewing opening 31 of the peek-a-boo pocket 30 at both sides of the body cover 10.

Preferably, the shield flap 32 has a width slightly narrower than a width of the viewing opening 31 and the shield flap 32 has a predetermined length approximately 3 inches to overlap with the upper portion 132A of the lower piece 132 of the pocket panel 13.

The hanging means 20 comprises two elongated hanging straps 21, 22 integrally extended from the side panel 12 and the main panel 11 respectively, wherein the two hanging straps 21, 22 are adapted for encircling around the neck portion of the mother user M. Therefore, the body cover 10 can be loosely hung in front of the chest portion of the mother user M, as shown in FIG. 2. Preferably, one of the hanging straps 22 connected to a top edge of the main panel 11 has a length longer than a length of the other hanging strap 21 connected to a top edge of the side panel 12 such that the two ends of the two hanging straps 21, 22 will meet each other at the mother's shoulder for easy and convenient attachment.

The hanging means 20 further comprises a fastening means 40 for detachably connecting the two connecting ends of the two hanging straps 21, 22 with each other. According to the preferred embodiment, the fastening means 20 comprises two pairs of buttons 221 respectively provided on both sides of the connecting end of the hanging strap 22 and that a pair of button slots 211 are correspondingly provided on the connecting end of the hanging strap 21, so that the either pair of the buttons 221 can be fastened with the pair of button slots 211 to fasten the two connecting ends of the hanging straps 21, 22 together.

Alternatively, the buttons 221 and the button slots 211 can be substituted by snap buttons or loop and hook fasteners. Also, the fastening means 20 may further comprises a pocket button stitched on the shield flap 32 adapted to fasten with a button slot provided on the upper portion 132A of the lower piece 132 of the pocket panel 13 for closing the viewing opening 31 such that the mother user can open the peek-a-boo pocket 30 while feeding and close the peek-a-boo pocket 30 when normal wearing the nursing cover up 1.

Figure 4:
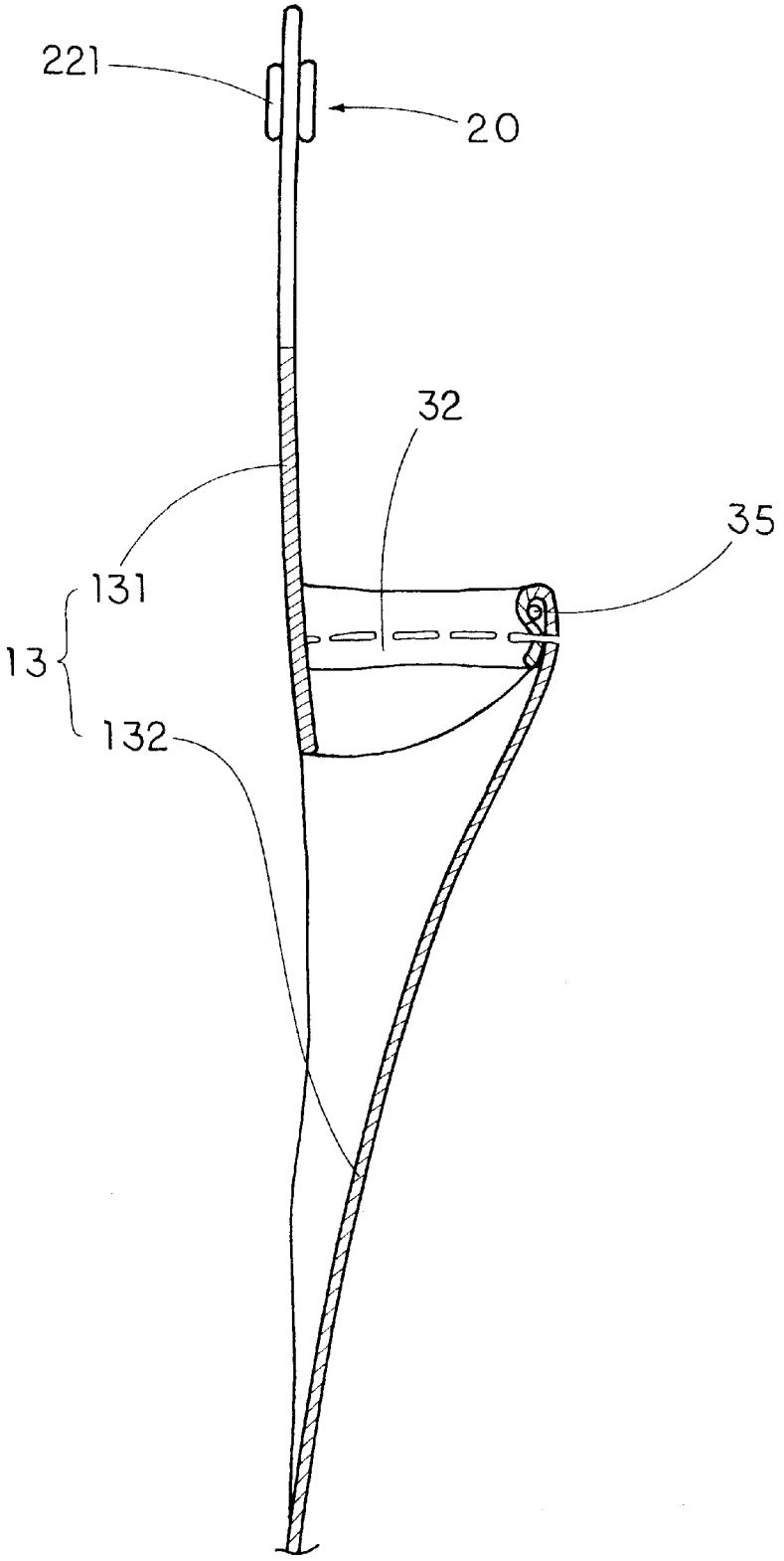
FIG. 4 is a sectional side view of an alternative mode of the nursing cover according to the above preferred embodiment of the present invention.

As shown in FIG. 4, an alternative mode of the above preferred embodiment of the present invention, wherein the supporting means 30 merely comprises a flexible supporting wire 35 extended along the pocket lip 33 to substitute the supporting lining layer 34 of the above preferred embodiment. The supporting wire 35 well supports the pocket lip 33 apart from the shield flap 32, which is flatly rest on the upper part of the breast of the mother user M, so as to maintain the viewing opening 31 in open condition during breastfeeding.

Furthermore, the body cover 10 is adapted to be reversibly worn for aiming at one side nursing such that the mother is able to nurse with her full capacity. In other words, for example, when the mother user M is wearing the nursing cover up 1 of the present invention with the first side 10A of the body cover 10 facing outside, as shown in FIG. 2, the peek-a-boo pocket 30 is positioned in front of the left breast of the mother user M, designed for nursing her baby with her left breast. However, when the mother user M reversely wears the nursing cover up 1 of the present invention with the second side 10B of the body cover 10 facing outside, where the shield flap 32 is also turned behind the upper portion 132A of the lower piece 132 of the pocket panel 13, the peek-a-boo pocket 30 is positioned in front of the right breast of the mother user M for nursing her baby with her right breast.

The advantages of the nursing cover up of the present invention include the following:

1. The nursing cover up is hung on the mother's body covering her chest portion to prevent her body from being exposed while breastfeeding.

2. Mothers will not feel embarrassing anymore while breastfeeding in public since the nursing cover up is adapted to cover their sensitive parts of their bodies that mothers are able to breastfeeding their babies anytime or anywhere without destroying their beauty and femininity.

3. Mothers not only are able to view and monitor their babies through the opening of the peek-a-boo pocket of the nursing cover up but also can keep their privacy while breastfeeding.

4. One single nursing cover up of the present invention can be used to selectively cover either the left breast or right breast of the mother by using either side of the cover up.

What is claimed is:

1. A nursing cover up comprising a body cover having a size adapted for covering at least a chest portion of a mother user and a hanging means for hanging said body cover in front of said mother user, said body cover comprising a main panel, a side panel and a pocket panel positioned between said main panel and said side panel, said pocket panel and said side panel being capable of covering one side of said chest portion of said mother user while said main panel is capable of covering another side of said chest portion of said mother user, said body cover further comprising a peek-a-boo pocket which has a viewing opening formed on said pocket panel that separates said pocket panel into an upper piece and a lower piece, said peek-a-boo pocket comprising a shield flap which extends from a bottom portion of said upper piece of said pocket panel to overlappingly position behind an upper portion of said lower piece of said pocket panel for covering an upper portion of a breast of said mother user, and a pocket lip formed at a top edge of said upper portion of said lower piece wherein said upper portion of said lower piece of said pocket panel is wider than said bottom portion of said upper piece so as to define said viewing opening between said shield flap and said pocket lip for said mother user to monitor her baby therethrough while breastfeeding.

2. The nursing cover up, as recited in claim 1, wherein said peek-a-boo pocket further comprises means for supporting said pocket lip to keep apart from said shield flap so as to maintain said viewing opening in an open condition.

3. The nursing cover up, as recited in claim 2, wherein said supporting means comprises a supporting lining layer attached to at least said upper portion of said lower piece so as to increase said weight of lower piece of said pocket panel with respect to said upper piece of said pocket panel, said main panel and said side panel, wherein said heavier upper portion of said lower piece of said pocket panel remains dropping apart from said shield flap due to gravity.

4. The nursing cover up, as recited in claim 3, wherein said supporting lining layer is made of a stiffness lining fabric stitched to attach on an entire surface of said lower piece of said pocket panel so that said lower piece of said pocket panel is thicker than said upper piece of said pocket panel, said main panel and said side panel of said body cover.

5. The nursing, cover up, as recited in claim 2, wherein said supporting means comprises a supporting wire extended along, said pocket lip to support said pocket lip apart from said shield flap so as to maintain said viewing, opening, in said open condition.

6. The nursing cover up, as recited in claim 1, wherein said shield flap of said peek-a-boo pocket is integrally and downwardly extended from said bottom portion of said upper piece of said pocket panel, wherein two sides of said shield flap are remained not to connect with either said upper piece or said lower piece, so that said shield flap is capable of reversibly flipping over from one side to another side of said body cover.

7. The nursing cover up, as recited in claim 2, wherein said shield flap of said peek-a-boo pocket is integrally and downwardly extended from said bottom portion of said upper piece of said pocket panel, wherein two sides of said shield flap are remained not to connect with either said upper piece or said lower piece, so that said shield flap is capable of reversibly flipping over from one side to another side of said body cover.

8. The nursing cover up, as recited in claim 3, wherein said shield flap of said peek-a-boo pocket is integrally and downwardly extended from said bottom portion of said upper piece of said pocket panel, wherein two sides of said shield flap are remained not to connect with either said upper piece or said lower piece, so that said shield flap is capable of reversibly flipping over from one side to another side of said body cover.

9. The nursing cover up, as recited in claim 5, wherein said shield flap of said peek-a-boo pocket is integrally and downwardly extended from said bottom portion of said upper piece of said pocket panel, wherein two sides of said shield flap are remained not to connect with either said upper piece or said lower piece, so that said shield flap is capable of reversibly flipping over from one side to another side of said body cover.

10. The nursing cover up, as recited in claim 1, wherein said hanging means comprises two elongated hanging straps integrally extended from said side panel and said main panel respectively and a fastening means for detachably connecting two connecting ends of said two hanging straps with each other.

11. The nursing cover up, as recited in claim 3, wherein said hanging means comprises two elongated hanging straps integrally extended from said side panel and said main panel respectively and a fastening means for detachably connecting two connecting ends of said two hanging straps with each other.

12. The nursing cover up, as recited in claim 5, wherein said hanging means comprises two elongated hanging straps integrally extended from said side panel and said main panel respectively and a fastening means for detachably connecting two connecting ends of said two hanging straps with each other.

13. The nursing cover up, as recited in claim 6, wherein said hanging means comprises two elongated hanging straps integrally extended from said side panel and said main panel respectively and a fastening means for detachably connecting two connecting ends of said two hanging straps with each other.

14. The nursing cover up, as recited in claim 8, wherein said hanging means comprises two elongated hanging straps integrally extended from said side panel and said main panel respectively and a fastening means for detachably connecting two connecting ends of said two hanging straps with each other.

15. The nursing cover up, as recited in claim 9, wherein said hanging means comprises two elongated hanging straps integrally extended from said side panel and said main panel respectively and a fastening means for detachably connecting two connecting ends of said two hanging straps with each other.

16. The nursing cover up, as recited in claim 10, wherein said fastening means comprises two pairs of buttons respectively provided on both sides of said connecting end of said hanging strap and that a pair of button slots are correspondingly provided on said connecting end of said hanging strap, so that said either pair of said buttons is able to be fastened with said pair of button slots to fasten said two connecting ends of said hanging straps together.

17. The nursing cover up, as recited in claim 11, wherein said fastening means comprises two pairs of buttons respectively provided on both sides of said connecting end of said hanging strap and that a pair of button slots are correspondingly provided on said connecting end of said hanging strap, so that said either pair of said buttons is able to be fastened with said pair of button slots to fasten said two connecting ends of said hanging straps together.

18. The nursing cover up, as recited in claim 12, wherein said fastening means comprises two pairs of buttons respectively provided on both sides of said connecting end of said hanging strap and that a pair of button slots are correspondingly provided on said connecting end of said hanging strap, so that said either pair of said buttons is able to be fastened with said pair of button slots to fasten said two connecting ends of said hanging straps together.

19. The nursing cover up, as recited in claim 14, wherein said fastening means comprises two pairs of buttons respectively provided on both sides of said connecting end of said hanging strap and that a pair of button slots are correspondingly provided on said connecting end of said hanging strap, so that said either pair of said buttons is able to be fastened with said pair of button slots to fasten said two connecting ends of said hanging straps together.

20. The nursing, cover up, as recited in claim 15, wherein said fastening means comprises two pairs of buttons respectively provided on both sides of said connecting end of said hanging strap and that a pair of button slots are correspondingly provided on said connecting end of said hanging, strap, so that said either pair of said buttons is able to be fastened with said pair of button slots to fasten said two connecting, ends of said hanging straps together.

* * * * *